United States Patent [19]

DeRisi

[11] Patent Number: 4,607,612

[45] Date of Patent: Aug. 26, 1986

[54] FIREPLACE FURNACE

[76] Inventor: Joseph DeRisi, Box 87D, Rte. 1, Casar, N.C. 28020

[21] Appl. No.: 737,274

[22] Filed: May 23, 1985

[51] Int. Cl.[4] ..... F24B 7/00

[52] U.S. Cl. ..... 126/121; 126/126; 126/134; 126/138; 126/163 R; 126/164; 126/285 A; 126/288

[58] Field of Search ..... 126/77, 113, 121, 123, 126/120, 126, 134, 135, 138, 139, 140, 163 R, 164, 285 A, 288; 165/109 T

[56] References Cited

U.S. PATENT DOCUMENTS

| | | | |
|---|---|---|---|
| 4,178,908 | 12/1979 | Trexler | 126/121 |
| 4,254,756 | 3/1981 | Wells | 126/121 |
| 4,258,879 | 3/1981 | Nischwitz | 126/121 X |
| 4,291,670 | 9/1981 | Hyatt | 126/121 |
| 4,324,223 | 4/1982 | Schwartz | 126/190 |
| 4,353,350 | 10/1982 | Albrecht | 126/121 |
| 4,354,480 | 10/1982 | Henderson et al. | 126/121 X |
| 4,381,760 | 5/1983 | Reges | 126/123 |
| 4,404,954 | 9/1983 | Steel | 126/121 |
| 4,475,531 | 10/1984 | Gerhart | 126/121 |
| 4,519,376 | 5/1985 | Schoeff et al. | 126/121 |

FOREIGN PATENT DOCUMENTS

| | | | |
|---|---|---|---|
| 2529646 | 1/1984 | France | 126/121 |

*Primary Examiner*—Margaret A. Focarino
*Attorney, Agent, or Firm*—W. Thad Adams, III

[57] ABSTRACT

A furnace insert (10) for an enclosed fireplace is disclosed. Furnace (10) includes an outer housing (11) and an inner housing (50) which define a firebox (11A). A plurality of tubular steel ducts (45–52), inclusive, are mounted within firebox (11A) and heat air as it rises through the ducts from inlets at the bottom and out of outlets at the top. Additional heat is recovered from the furnace and, in addition, an insulating effect is created which prevents damage to the fireplace walls by a heat exchange chamber (54) which is defined by a space between inner housing (11) and outer housing (50) which has an air inlet (54A) at the bottom and an air outlet (54A) at the top.

10 Claims, 6 Drawing Figures

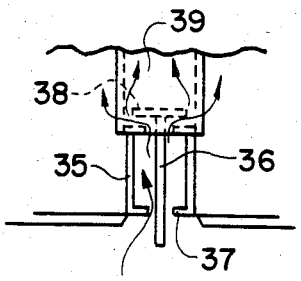
FIG. 3
FIG. 4
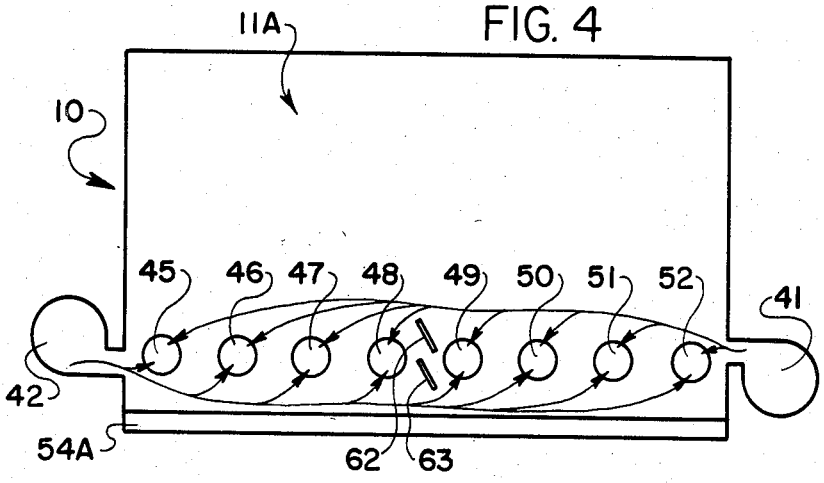
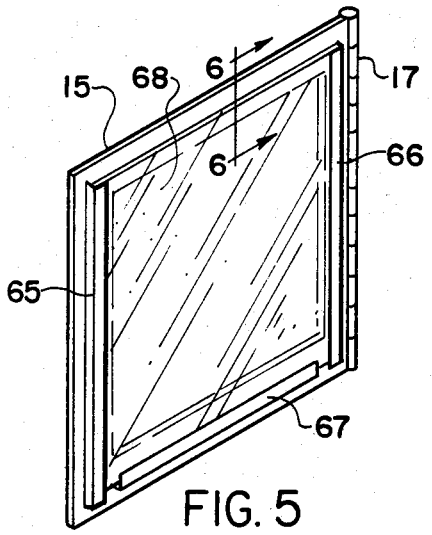
FIG. 5
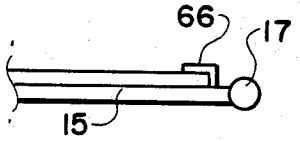
FIG. 6

FIREPLACE FURNACE

TECHNICAL FIELD AND BACKGROUND OF THE INVENTION

This invention relates to an insert designed to be fitted within a fireplace in order to form a furnace which will burn a solid fuel, such as firewood or coal, for use in home heating. The invention disclosed in this application provides a number of features not shown in the prior art which, collectively, permit the furnace to make efficient use of the solid fuel being burned. Despite the relatively high heat output, a novel arrangement of tubular heating ducts and an outer heat exchange chamber prevent overheating of the furnace and of the inside walls of the fireplace itself. Furthermore, the inclusion of large glass doors on the furnace permit the fire to be viewed while retaining the efficiency of the furnace, or, if desired, viewed with the doors open so that the furnace functions essentially as a fireplace but with the ability to recover and dispense into the room substantial heat which would otherwise be lost.

SUMMARY OF THE INVENTION

Therefore, it is an object of the invention to provide a furnace insert which makes efficient use of heat generated in the furnace firebox.

It is another object of the invention to provide a furnace insert which can be used with or without power assisted blowers.

It is another object of the invention to provide a furnace insert having heat recovery means which also acts as an insulating barrier between the firebox and the fireplace.

It is yet another object of the invention to provide a furnace which can be used as an enclosed furnace with controlled combustion air flow or as a fireplace with open access to the firebox.

It is yet another object of the present invention to provide a furnace insert with an integrally formed humidifier for introducing moisture into the room to be heated.

These and other objects of the present invention are achieved in the preferred embodiment disclosed below by providing generally box-shaped sheet metal outer and inner housings, each having bottom, top, rear and opposing side walls to define a heat exchange chamber therebetween. A heat exchange chamber air inlet is provided for admitting air to the heat exchange chamber for heating and a heat exchange air outlet is provided for permitting air which has entered the heat exchange chamber through the inlet to be discharged into the area to be heated.

A flue is formed in the top of the furnace insert through the top walls of the first and second housing walls to permit combustion gases to exit the furnace insert through the fireplace chimney. An array of generally U-shaped tubular ducts is positioned in spaced-apart relation within the inner housing and within the firebox to absorb heat. Each of the tubular ducts defines a lower air inlet and an upper air outlet for permitting air to enter the ducts, absorb heat and exit the ducts into the area to be heated. At least some of the ducts are positioned directly under the flue to absorb heat which would otherwise exit the furnace through the flue.

Preferably, a plenum is positioned from one side to the other of the furnace and is fluidly connected to the heat exchanger air outlet and the tubular duct air outlet for receiving and blending the heated air for introduction into the room to be heated.

According to a preferred embodiment of the invention, the plenum includes a water reservoir having an open top across which blended air flows as it exits the plenum in order to add moisture to the air.

The furnace insert according to the preferred embodiment set forth in this application includes a pair of doors pivotally secured by piano hinges to the furnace through which fuel may be added to and removed from the firebox. Furthermore, when the doors are left in their open position, the furnace may be used as an open fireplace.

Preferably, the tubular ducts are spaced-apart from the bottom wall of the inner housing to form a fuel supporting platform with a space therebeneath for accumulation of ashes.

The furnace insert according to the invention is provided with a damper for controlling the flow of combustion air into the firebox. The damper preferably comprises a conduit positioned with one end inside the firebox and the other end outside the firebox in such manner as to permit combustion air to flow into the firebox. An elongate control rod extends through the conduit from one end to the other end. A handle is positioned on the outside end of the control rod for manual manipulation. A plate is secured to the inside end of the control rod and is manually moveable between a range of positions for varying the flow of combustion air. At one extreme position with the control rod pushed inwardly towards the firebox, the plate is positioned in spaced-apart relation from the end of the conduit to permit combustion air to flow into the firebox. As the handle of the control rod is pulled outwardly away from the firebox, the amount of combustion air admitted into the firebox is reduced. At the other extreme position, the plate is positioned in mating contact with the inside end of the conduit to restrict the flow of combustion air into the firebox.

According to a preferred embodiment of the invention, a baffle, comprising an elongate piece of flat steel twisted into a spiral shape is positioned within the tubular ducts to divert the flow of air into a spiral shape to cause the air to take a circuitous path through the ducts from one end to the other, thereby absorbing more heat.

According to one embodiment of the invention, the furnace insert includes two powered blowers. One powered blower is positioned on each side of the firebox and the inlets of the blowers are vertically offset in relation to each other to move air from one blower past air from the other blower to minimize air flow resistance and air flow turbulence.

Preferably, each of the doors of the fireplace insert includes a frame for removeably holding a sheet of tempered glass or an imperforate piece of sheet metal.

BRIEF DESCRIPTION OF THE DRAWINGS

Some of the objects of the invention have been set forth above. Other objects and advantages of the invention will appear as the description of the invention proceeds when taken in conjunction with the following drawings, in which:

FIG. 3 is a fragmentary top plan view of the damper;

FIG. 4 is a schematic view of the air blowers with vertically offset blower inlets to reduce air flow resistance and air turbulence;

FIG. 5 is a perspective view of one of the doors of the furnace; and

FIG. 6 is a cross-sectional view taken substantially along lines 6—6 of FIG. 5 showing the mounting arrangement for a sheet of tempered glass.

DESCRIPTION OF THE PREFERRED EMBODIMENT

Figure 1:
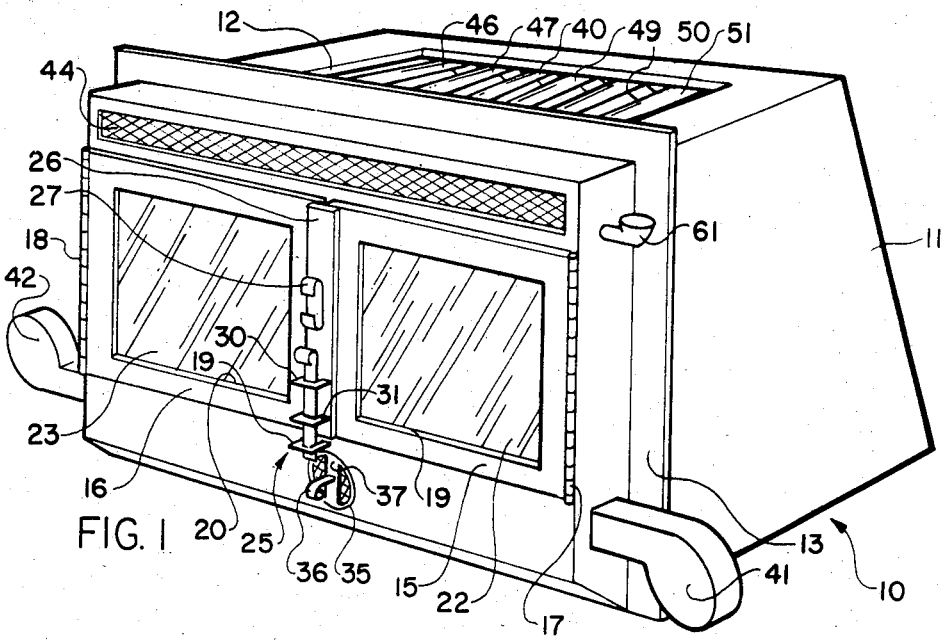
FIG. 1 is a perspective view of the furnace insert according to the invention.

Referring now specifically to the drawings, a furnace insert 10 according to the invention is shown. Furnace 10 includes an outer housing 11 and an inner housing 50 which defines an enclosed firebox 11A, a flue 12 and a flange 13 for overlapping the fireplace walls and permitting a sealing engagement between furnace 10 and the fireplace. The front of furnace 10 is enclosed by a pair of doors 15 and 16 mounted, respectively, for pivotal movement on piano hinges 17 and 18. Doors 15 and 16 have relatively large sized cut-outs 19 and 20 for holding either sheets of tempered glass 22 and 23, or sheets of perforated metal.

Doors 15 and 16 are held in their closed position by means of a door lock assembly 25, which includes a locking plate 26 welded to door 15 and overlapping onto the closed door 16. Door lock assembly 25 includes a stationary handle 27 and a vertically sliding lock 28. The sliding lock is held in position by two spaced-apart lock brackets 30 and 31. The doors 15 and 16 are locked by sliding the sliding lock 28 downwardly into a third lock bracket 32 which is welded onto the front of furnace 10 directly beneath brackets 30 and 31. With sliding lock 28 in its lower position, doors 15 and 16 are held firmly against furnace 10.

Combustion air is admitted into the firebox by means of a damper, which comprises a metal pipe forming a conduit 35 welded into a hole in furnace 10 just below doors 15 and 16, with one end of the outside and another end on the inside. A control rod 36 is held in conduit 35 by means of a control rod brace 37. Movement of control rod 36 inwardly and outwardly increases and reduces, respectively, the amount of combustion air admitted into firebox 11A.

As is shown in FIG. 3, a plate 38 is secured to the inner end of control rod 36. Plate 38 is oversized relative to the size of conduit 35 so that when control rod 35 is pulled outwardly, plate 38 sits against the mouth of conduit 35 and effectively stops the flow of combustion air into firebox 11A. By pushing control rod 38 inwardly, a progressively increasing quantity of air is admitted. Therefore, control of the combustion rate of the fuel is easy to accomplish. Plate 38 also deflects the incoming air to both sides of firebox 11A rather than permitting it to be concentrated in the center. In many prior furnaces having a center-positioned damper, the center sections of the logs burn away, leaving unburned sections on either end. By deflecting the air as described, this is prevented.

In addition, damper cover 39 is positioned above the mouth of conduit 35 and prevents ashes from accumulating in the mouth of conduit 35. This prevents blockage or restriction of combustion air flow.

Air to be heated is introduced into the firebox of furnace 10 by means of two blowers 41 and 42. Heated air is exhausted through a plenum 44 covered by a decorative and protective grille 44A. Mounted within the firebox 11A is a plurality of tubular steel ducts 45–52, inclusive. (Ducts 46–51 are shown in FIG. 1; all in FIG. 4).

The construction and operation of furnace 10 will now be described in further detail with reference to FIG. 2. Inside the outer housing 11 is an inner housing 50. Outer housing 11 and inner housing 50 have essentially corresponding bottom, top, rear and opposing side walls which are formed in spaced-apart relation to define a heat exchange chamber 54 therebetween. The flue 12 is cut from the top walls of the inner and outer housings 11 and 50 and the cut area is sealed by welding a plate 53 around the periphery of the cut-out to seal the heat exchange chamber 54 against air flow communication between the heat exchange chamber 54 and the combustion gases which exit through flue 12. Heat exchange chamber 54 is open along its bottom to define an air inlet 54A and, in addition, open at the top to define an air outlet 54B.

The tubular ducts 45–52, referred to above in connection with FIG. 1, are mounted within the firebox 11A of furnace 10 in close proximity to the bottom, back and top walls of inner housing 50. All of the tubular ducts 45–52 are constructed in essentially the same manner. For purposes of illustration and simplicity, further reference in some cases will be made solely to tubular duct 49.

Tubular duct 49 is formed of cylindrical steel pipe and is formed of separate, straight segments welded together to be substantially U-shaped and includes a lower air inlet 49A and an upper air exit 49B. Individual pieces of flat steel are twisted into a spiral shape and positioned within tubular duct 49 to define baffles 57, 58 and 59. The spiral shape of baffles 57, 58 and 59 cause the air entering inlet 49A to move in a spiral manner around the outer walls of tubular duct 49, thereby absorbing more heat than would be the case if the air moved in an essentially straight line manner through duct 49 from its inlet 49A to its outlet 49B. By combined reference to FIGS. 1 and 2, it can be seen that each of the tubular ducts 45–62 are positioned in spaced-apart relation underneath flue 12. As combustion gases exit furnace 10 through flue 12, they pass around and between ducts 45–52, thereby further heating the air within the ducts. As can also be seen by combined reference to FIGS. 1 and 2, air within heat exchange chamber 54 must take a circuitous path to either side of flue 12 before exiting through outlet 54B.

Figure 2:
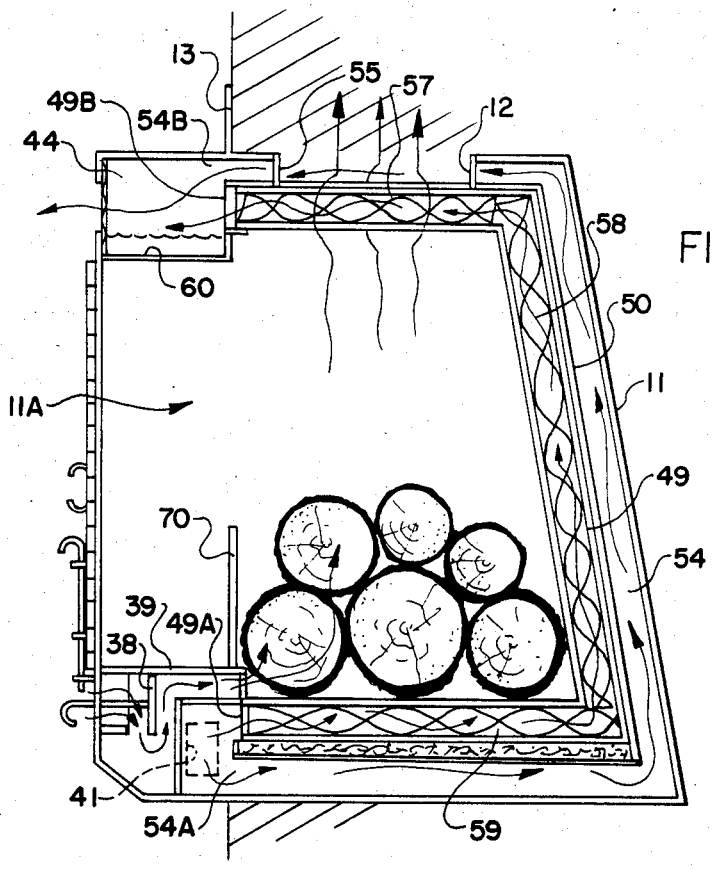
FIG. 2 is a vertical cross-sectional view of the furnace insert shown in FIG. 1, with the section through one of the tubular ducts.

As is shown in FIG. 2, tubular duct 49, as is also the case with tubular ducts 45–52, are spaced apart from the bottom wall of inner housing 50. Bottom wall of inner housing 50 defines a floor and the bottom portion of tubular duct 49 provides a raised surface upon which the fuel can be placed. As the fuel is consumed, ashes fall through the cracks between ducts 45–52 onto the floor defined by the bottom wall of inner housing 50. Air is introduced into the heat exchange chamber 54 and ducts 45–52 through blowers 41 and 42. Air from blower 41 is directed into heat exchange chamber 54 and tubular ducts 45–52. The air exits through the tubular ducts 45–52 and heat exchange chamber outlet 54B, respectively into the plenum 44.

As is shown in FIG. 2, plenum 44 may optionally include a water reservoir 60 into which water is poured through a filler 61 (FIG. 1). As hot air exits outlets 49B and 54B, it takes up moisture from water in reservoir 60 and introduces it into the area being heated. If a slower rate of evaporation is desired, a perforated, metal plate (not shown) can be positioned over the top of reservoir 60.

As mentioned above, blowers 41 and 42 are vertically off-set so that the air from the blowers does not directly collide. To assist the two opposing air streams in passing each other, a pair of deflectors 62 and 63 are positioned forward of and between the inlets to tubular ducts 48 and 49. Air from blower 41 is deflected upwardly slightly by deflector 62 and the air from blower 42 is deflected downwardly slightly by deflector 63. This amount of deflection is just enough to reduce air turbulence and noise and also permits blowers 41 and 42 to work more efficiently since back pressure is reduced.

FIG. 5 shows the inner side of door 15. Three L-shaped brackets 65, 66 and 67 are welded to opposite sides and bottom, respectively, of door 15. As is shown in FIG. 6, the space formed by the L-shaped brackets is used to accommodate a piece of solid sheet metal 68 (FIG. 5) or a sheet of glass 22 (FIG. 1). The appearance and function of furnace 10 can therefore be changed, as desired, by replacing the metal sheets with glass and vice versa. Also, if a piece of glass is broken, replacement is very easily accomplished.

One of the problems attendant in the use of many prior art fireplace inserts is that they are manufactured to be substantially flush with the walls surrounding the fireplace. The average fireplace is no shallower than about 19 inches (45 cm). This means in some cases that the firebox is very shallow and the fuel is therefore consumed while sitting very close to the doors. In addition to the obvious danger from sparks or incidental human contact while the doors are open, when the doors are closed the fire is so close that the doors can be warped or the door glass broken by the intense heat.

As is most clearly shown in FIGS. 1 and 2, the front of furnace 10 sits forward of the fireplace walls. This not only provides additional space for the inlets, outlets and damper, but, as is shown in FIG. 2, ample space is provided for the fuel while nevertheless providing a safe distance (approximately 12 in., 30.5 cm) between the fuel and the front of the fireplace. The logs are prevented from falling forward by an andiron 70 positioned within firebox 11A and extends along the front of firebox 11A.

Fireplaces are built in many different sizes. However, most conventional fireplaces are not lower than 26 inches (66 cm) and not higher than 31 inches (79 cm). Therefore, a suitable height for fireplace 10 is approximately 25 inches (63.5 cm) with a various range of widths of from 32 inches (81 cm) to 40 inches (101.6 cm), depending upon the width of the fireplace. Flange 13 which extends around the sides and top of fireplace 10 is preferably about 4 inches (10 cm) wide and permits a range of variation of furnace to fireplace size while nevertheless insuring a proper ceiling overlap between flange 13 and the fireplace walls. If necessary, flange 13 can be attached by screws or other masonry attachment means to the fireplace walls.

It has also been observed that the presence of a relatively large quantity of ashes within the furnace greatly increases the efficieny of tubular ducts 45–52. The ashes form an insulation barrier on the lower end of the ducts which provide a more even heat distribution and also prevent the ducts from eventually burning out. Preferably, ducts 45–52 are each two inches (5 cm) in outside diameter with spacing between them of not less than about ½ inch (1.3 cm) to permit the ashes to drop freely through to the bottom of firebox 11A. No ashtray is needed since the ashes need only to be removed once they accumulate to a position above the level of the ducts.

A furnace insert for an enclosed fireplace is disclosed above. Various details of the invention may be changed without departing from its scope. Furthermore, the foregoing description of a preferred embodiment of a furnace insert according to the present invention is provided for the purpose of illustration only and not for the purpose of limitation—the invention being defined by the claims.

I claim:

1. A furnace insert for an enclosed fireplace having an open front and a chimney, said furnace insert comprising:

a. a generally box-shaped sheet metal outer housing positioned within the fireplace and extending outwardly from within the fireplace and lapping the surrounding fireplace walls, said housing having bottom, top, rear and opposing side walls;

b. a generally box-shaped sheet metal inner housing defining a firebox, said inner housing positioned within said outer housing and having bottom, top, rear and opposing side walls in spaced-apart relation to the corresponding walls of said outer housing to define a heat exchange chamber therebetween;

c. a heat exchange chamber air inlet between the bottom wall of the outer housing and the bottom wall of the inner housing for admitting air to said heat exchange chamber for heating;

d. a heat exchanger air outlet between the top wall of the outer housing and the top wall of the inner housing for permitting air which has entered said heat exchanger chamber through said inlet and has been heated within said heat exchange chamber to exit said heat exchange chamber into the area to be heated;

e. a flue formed in the top of said furnace insert through the top walls of said first and second housing walls and sealed against air flow communication with said heat exchange chamber to permit combustion gases to exit said furnace insert through the fireplace chimney; and f. an array of generally U-shaped tubular ducts positioned in spaced-apart relation within said inner housing and said firebox to absorb heat, each of said tubular ducts defining a lower air inlet and an upper air outlet for permitting air to enter the ducts, absorb heat and exit the ducts into the area to be heated, at least some of said ducts being positioned directly under said flue to absorb heat which would otherwise exit the furnace through said flue;

g. a conduit positioned with one end inside said firebox and the other end outside said firebox in combustion air flow relation to said firebox;

h. an elongate control rod extending through said conduit from one end to the other end and having a handle on the end of the control rod on the outside end of said conduit for manual manipulation;

i. a plate secured to the inside end of said control rod for selective movement between a range of positions wherein at one extreme position with the control rod pushed inwardly towards the firebox, said plate is positioned in spaced-apart relation from the end of the conduit to permit combustion air to flow into the firebox and, wherein, at the other extreme position said plate is positioned in mating contact with the inside end of the conduit to restrict the flow of combustion air into the firebox; and j. a damper cover positioned within said firebox on top of and in front of said conduit in spaced-apart relation thereto to direct the flow of combustion air to the sides of said conduit and to opposite sides of said firebox for even distribution of combustion air to the fuel and, to prevent the accumulation of ashes within close proximity of said conduit in order to prevent restriction of the flow of combustion air therethrough;

whereby the efficiency of the furnace is increased by increasing the maximum possible air flow, the fireplace walls are protected against excessive heat by an insulating effect created by said heat exchange chamber and heat is distributed evenly around the walls of the furnace for passage into the area to be heated.

2. A furnace insert according to claim 1, and including a plenum positioned from one side to the other side of said furnace and fluidly connected to said heat exchanger air outlet and said tubular duct air outlets for receiving and blending the heated air therefrom for introduction into the air to be heated.

3. A furnace insert according to claim 2, wherein said plenum includes a water reservoir having an open top across which said blended air flows as it exits said plenum, in order to add moisture to the air.

4. A furnace insert according to claim 1, and including a pair of doors pivotally secured by piano hinges to said furnace, through which doors fuel may be added to and ashes removed from said firebox, and, when said doors are left in their open position, the furnace may be used as an open fireplace.

5. A furnace insert according to claim 1, wherein said tubular ducts are spaced-apart from the bottom wall of the inner housing to form a fuel supporting platform and to provide space therebeneath for accumulation of ashes.

6. A furnace insert according to claim 1, and including at least one powered blower communicating with said heat exchange chamber and the inlet of each of the tubular ducts for forcing air through said heat exchange chamber and said tubular ducts for heating.

7. A furnace insert according to claim 1, wherein an elongate air flow diverting baffle is positioned within at least some of said tubular ducts to increase heat absorption by the air within said tubular ducts by causing the air to take a circuitous path through said ducts from one end to the other.

8. A furnace insert according to claim 7, wherein said baffle comprises an elongate piece of flat steel twisted into a spiral shape, with the edges of said spiral in contact with the inner walls of the tubular duct to cause air to move through the tubular ducts in a spiral manner.

9. A furnace insert according to claim 6, and including two powered blowers, one on each side of said firebox and the inlets of said blowers being vertically offset in relation to each other to move air from one blower past air from the other blower to minimize air flow resistance and air flow turbulence.

10. A furnace insert according to claim 4, wherein each door includes a frame defining an opening therein and means carried by said frame for removably holding a sheet of tempered glass or an imperforate piece of sheet metal.

* * * * *